United States Patent [19]

Brown

[11] Patent Number: 4,972,533

[45] Date of Patent: Nov. 27, 1990

[54] COMBINATION COMFORTER AND SLEEPING BAG

[76] Inventor: James P. Brown, c/0 Stanford's Marine Railway, 829 Robin Brove La., Colonial Beach, Va. 22443

[21] Appl. No.: 475,868

[22] Filed: Feb. 6, 1990

[51] Int. Cl.[5] ..... A47G 9/08; A47G 9/00

[52] U.S. Cl. ..... 5/413; 5/434; 5/482; 5/485; 362/800; 362/806; D6/601; D6/603

[58] Field of Search ..... 5/413, 485, 482, 434, 5/436, 462, 500, 502, 442, 462; 362/800, 801, 103, 806; D6/601, 602, 603

[56] References Cited

U.S. PATENT DOCUMENTS

| | | | |
|---|---|---|---|
| 3,120,721 | 2/1964 | Bukatman et al. | 5/485 |
| 4,236,263 | 12/1980 | Allel | 5/413 |
| 4,413,368 | 11/1983 | Schuetzl | 5/413 |
| 4,709,307 | 11/1987 | Branom | 362/800 |
| 4,759,090 | 7/1988 | Sachetti | 5/482 |
| 4,839,777 | 6/1989 | Danko et al. | 362/806 |
| 4,841,587 | 6/1989 | Carter et al. | 5/420 |
| 4,875,245 | 10/1989 | Isola | 5/482 |

OTHER PUBLICATIONS

Stereopillow TM an Ad on page 46 of the 5/78 issue of "Flotation Sleep Industry", Magazine

*Primary Examiner*—Alexander Grosz
*Attorney, Agent, or Firm*—Rodger H. Flagg

[57] ABSTRACT

This invention relates to a combination comforter and sleeping bag, having top and bottom fabric portions each sized to substantially cover the top and end portions of a single bed. The top and bottom fabric portions are removably secured about their sides and bottom portions. Indicia in the characterization of the body of a person, animal, creature, monster, alien or thing is disposed upon one side of the top fabric portion. A head portion is removably secured along the top side of the bottom portion, with indicia in the characterization of the head of a person, animal, creature, monster, alien or thing dipicted upon the body portion. Preferably the head portion includes an audio device with battery, switch and speakers disposed in the head portion. The head portion may also include at least one visual light source with battery and switch. Where both an audio device and visual light source are included in the head portion, a common switch and battery source may be employed.

18 Claims, 2 Drawing Sheets

COMBINATION COMFORTER AND SLEEPING BAG

BACKGROUND OF THE INVENTION

This invention relates to a combination comforter and sleeping bag. Prior art disclosing sleeping bags having a top portion secured to a bottom portion, with a zipper extending along one side and the bottom are well known in the art. Such sleeping bags are typically sized for single or double occupancy.

U.S. Pat. No. 3,613,133 discloses a bedspread and sheet having indicia disposed thereon.

U.S. Pat. No. 4,069,526 discloses a bed covering having left and right portions which are releasably secured along one side to form a single or double width covering.

U.S. Pat. No. 4,236,263 discloses a sleeping bag with the characterization of a figure disposed upon the top portion of the sleeping bag.

U.S. Pat. No. 4,674,130 discloses a sleeping bag which may be secured together with hook and loop type fasteners.

SUMMARY OF THE INVENTION

This invention relates to a combination comforter and sleeping bag. More specifically, this invention relates to a combination comforter and sleeping bag having top and bottom fabric portions sized to substantially cover the top and end portions of a single bed, with a head portion releasably secured to the upper end of the bottom fabric portion. Indicia in the form of the characterization of the body of a person, animal, creature, monster, alien, or thing is disposed upon one side of the top fabric portion, with a indicia in the form of the characterization of the face of a person, animal, creature, monster, alien or thing disposed upon the head portion.

The head portion preferably includes an audio device with speakers disposed within the head portion to selectively transmit audio signals from the audio device to the speakers.

The head portion also preferably includes a visual light source disposed within the head portion.

DETAILED DESCRIPTION OF THE PREFERRED EMBODIMENTS

Figure 1:
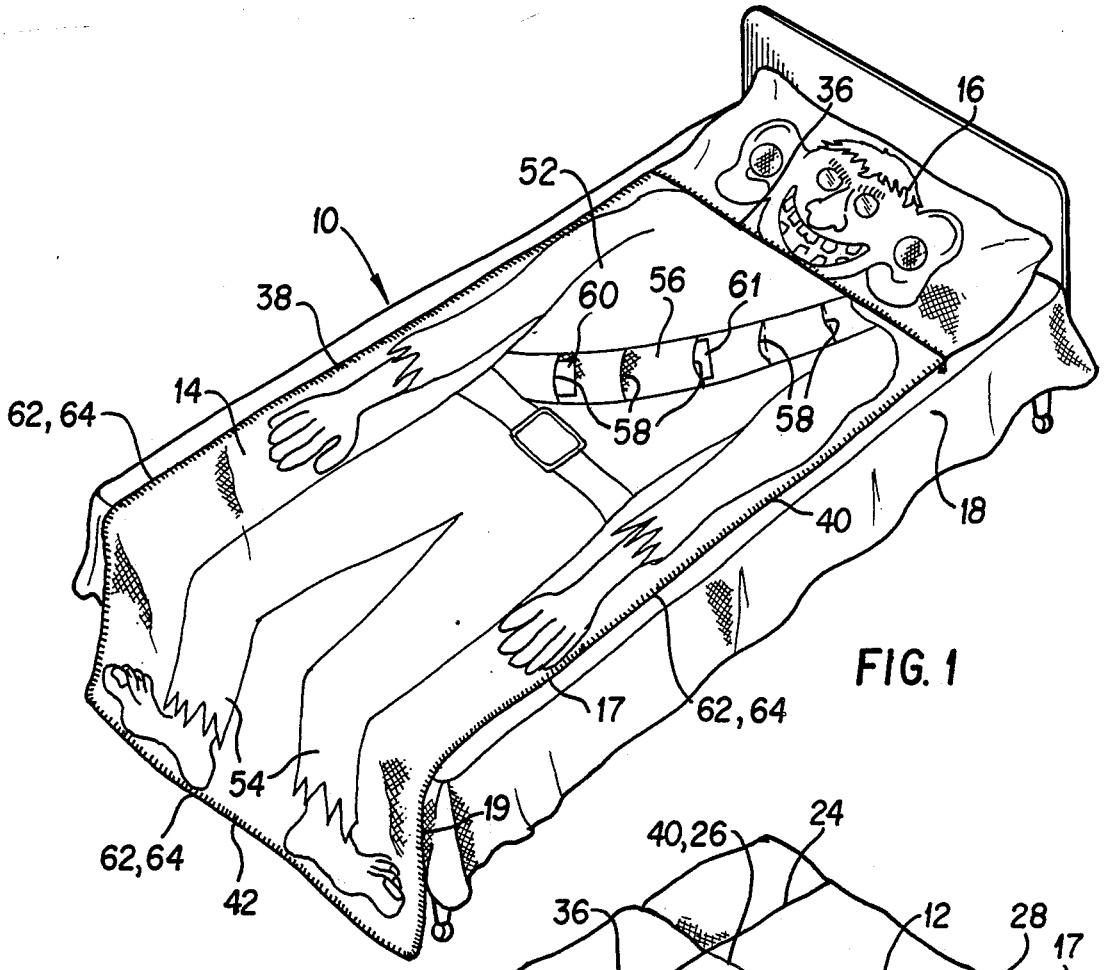
FIG. 1 shows a perspective view of the present invention showing the sleeping bag placed on a single bed, with the body and head portion attached.

The combination comforter and sleeping bag apparatus 10 comprises a bottom fabric portion 12, a top fabric portion 14, and a head portion 16. The top and bottom fabric portions 12, 14 are each sized to substantially cover the top and end portions of a single bed 18.

The bottom fabric portion 12 includes an inner side 20, an outer side 22, an upper end 24, left side 26, right side 28 and lower end 30.

The top fabric portion 14 includes an inner side 32, an outer side 34, an upper end 36, a left side 38, a right side 40 and a lower end 42.

Figure 6:
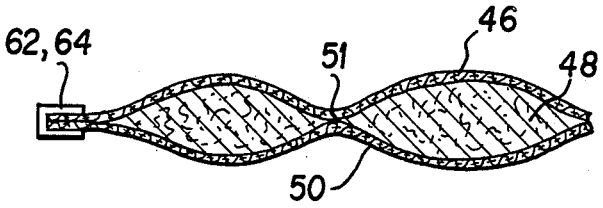
FIG. 6 is a cross sectional view of the preferred material used to form the top and bottom fabric portions.

The material 44 used to form the top and bottom fabric portions 12, 14 is preferably selected for warmth, and may include a waterproof outer layer 46, an intermediate insulating layer 48 and an inner layer 50. Preferably, the materials selected are fire retardant or fireproof. See FIG. 6.

The material 46, 48 and 50 may be joined by any conventional means 51, such as stitching, glueing, heat sealing, etc.

The top fabric portion 14 preferably has indicia disposed upon the outer layer 46 in the form of the characterization of the body 52 of a person, animal, creature, monster, alien or thing. The body 52 preferably has legs 54 extending from the middle portion of the top fabric portion 14 and the legs preferably extend near the lower end 42.

A sash 56 preferably extends diagonally across the body 52. The sash 56 may include pockets 58 for storage of various items. One such item may be in the form of a warrantee of ownership 60 of the sleeping bag apparatus 10. Other items may include a small notebook, writing instrument, spare batteries, auxiliary flashlight, etc.

The preferred size of the sleeping bag apparatus 10 is enlarged to substantially include the width of a single bed 18, with the length extended to substantially include both the top 17 and end 19 portions of a single bed 18.

This has the effect of enlarging the body 52 of the indicia. When the top fabric portion 12 is placed upon a single bed 18, the legs 54 of the indicia appear to be bent where the top 17 of the single bed 18 joins the end 19.

The top fabric portion 14 is releasably secured to the bottom fabric portion 12 about the left sides 26, 38; the lower ends 30, 42 and right sides 28, 40. Conventional zippers 62 may be used to releasably secure the top fabric portion 14 to the bottom fabric portion 12. Preferably, strips of hook and loop type fasteners 64 are used to secure the top and bottom fabric portions 12, 14. Strips of hook and loop type fasteners 64 are preferably secured to the left and right sides 26, 28, 38, 40, and the lower ends 30, 42.

The head portion 16 may be releasably secured to the upper end 24 of the bottom fabric portion 12 with a zipper 62 or with hook and loop type fasteners 64, according to manufacturing preference.

A strip or flap of fabric material may be installed along one side of the fastening means 62, 64 to protect and cover the fastening means. The strip or flap of fabric material may be folded back for access to the fastening means 62, 64.

Head portion 16 may include a soft, filled interior portion 66, for use as a pillow. The head portion 16 preferably includes indicia in the form of the characterization of a face 68 of the person, animal, creature, monster, alien or thing disposed upon the top fabric portion 14 of the sleeping bag apparatus 10.

Preferably, the head portion 16 includes an audio device 70 with speakers 72 adapted to selectively transmit audio signals in proximity to the user of the sleeping bag apparatus 10. The audio device 70 may be a tape player 74 suitable for transmission of prerecorded audio signals to the speakers 72 disposed within the head portion 16.

Alternately, the audio device 70 may be a radio receiver 75, suitable for receiving radio signals and transmitting the radio signals to the speakers 72 to produce audio sounds in accordance with the received radio signal.

The audio sounds may be in the form of music, prerecorded or transmitted voice messages, sounds of nature, white noise, etc.

The speakers 72 may be spaced apart to improve stereo sound, and may be placed in proximity to the ears on the face 68 disposed upon the head portion 16. The speakers 72 are preferably foam cell "pillow-type" speakers, which are waterproof, pliable and non-breakable during normal use.

Foam cell speakers provide a full range of audio sound over a limited distance from the speakers, and are normally used in close proximity to the listener.

Figure 4:
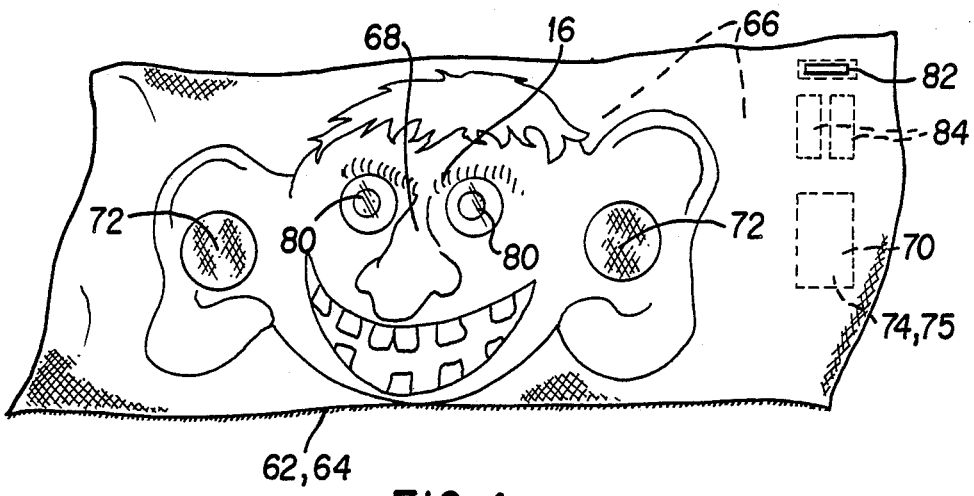
FIG. 4 shows the head portion of the sleeping bag, with indicia representing the head disposed thereon, with visual and audio portions shown.
Figure 5:
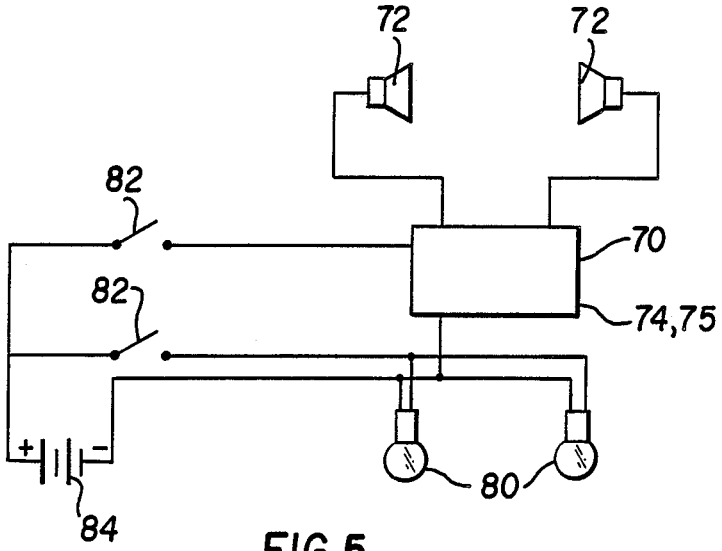
FIG. 5 is a block diagram of the combined visual light source and audio device disposed in the head portion of the sleeping bag.

The head portion 16 may also include a visual light source 80, suitable as a night light or adapted for use as a reading light. Preferably the light source comprises at least one light emitting diode (LED). The light source 80 is actuated by a suitable switch 82, which selectively controls the passage of current from a suitable battery source 84 to the light source 80. The light source 80 may be incorporated into the indicia representing a face 68, and may be positioned in proximity to the eyes on the face. A single light source may be in the form of the eye of a cyclops, or may symbolize a lighted miner's helmet, etc. Multiple eyes may also be used to achieve a desired effect. See FIG. 4.

Where audio and/or visual devices 70, 80 are included in the head portion of the apparatus 10, a switch 82 may be incorporated to actuate either or both of the audio or visual devices 70, 80. One or more batteries 84 may be secured within the head portion 16, in a manner to facilitate their replacement when needed. While batteries 84 are preferred for portability, it is within the scope of this invention to utilize any available power source to power the audio or visual devices 70, 80.

Figure 2:
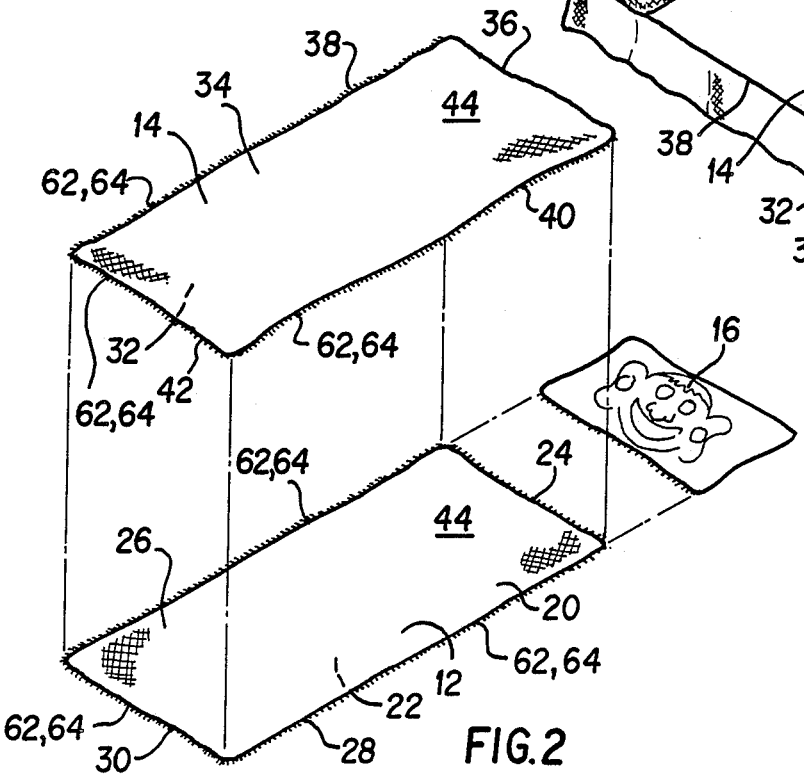
FIG. 2 shows the upper and lower fabric body portions and the head portion entirely separated.

As shown in FIG. 2, the top and bottom fabric portions 12, 14 may be entirely separated, for use as separate comforters on a single bed, or to snuggle with by the television or fire, etc.

Figure 3:
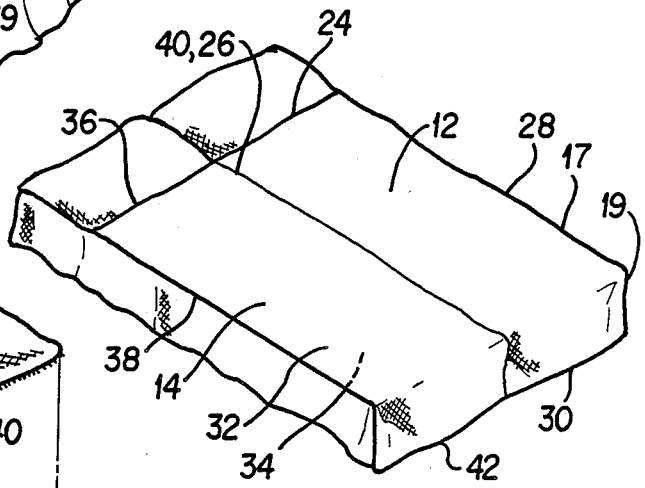
FIG. 3 shows the head portion removed, with the upper and lower fabric portions joined in side by side relation forming a comforter suitable for use on a double bed.

The top and bottom fabric portions 12, 14 may be selectively joined for use on a double bed as shown in FIG. 3, with the indicia turned down, and thus out of sight. The enlarged length of the top and bottom fabric portions 12, 14, enable their use as a bedspread or blanket on either a single or double bed, increasing their utility in a variety of situations.

The head portion 16 may be used independently of the top and bottom fabric portions 12, 14 as a pillow, if desired.

Thus, the combination comforter and sleeping bag 10 disclosed herein may be used in a variety of ways to suit the needs and wishes of the user.

Although the present invention has been described with reference to preferred embodiments, one skilled in this art may make numerous revision in form and detail, and such revisions are intended to fall within the scope of the following claims.

What is claimed is:

1. A combination comforter and sleeping bag apparatus, comprising:

(a) a bottom fabric portion sized to substantially cover the top and end portions of a single bed; the bottom fabric portion having an upper end, left and right sides, and a lower end;

(b) a top fabric portion sized to cover the top and end portions of a single bed; the top fabric portion having an upper end, left and right sides and a lower end;

(c) indicia in the form of the characterization of a body of a person, animal, creature, monster, alien, or thing disposed upon one side of the top fabric portion;

(d) a head portion having indicia in the form of the characterization of the face of the person, animal, creature, monster, alien, or thing disposed upon the top fabric portion of the sleeping bag;

(e) the top fabric portion and the bottom fabric portion may be removably secured to each other, with the head portion removably secured along the top side of the bottom fabric portion in a manner to align the indicia disposed upon the top fabric portion with the indicia disposed on the head portion;

(f) an audio device with speakers disposed within the head portion to selectively transmit audio signals in proximity to the user of the apparatus; and (g) at least one visual light source disposed in the head portion, wherein the audio device and visual light source are selectively controlled by a switching means.

2. The apparatus of claim 1, wherein the audio device comprises a tape player suitable for transmission of prerecorded audio signals to the speakers disposed within the head portion.

3. The apparatus of claim 1, wherein the speakers are foam cell speakers which are spaced apart within the head portion to provide stereo sound.

4. The apparatus of claim 1, wherein the audio device comprises a radio receiver, suitable for receiving radio signals and transmitting the radio signals to the speakers to produce audible sounds.

5. The apparatus of claim 1, wherein the indicia disposed upon the top fabric portion includes a sash portion extending diagonally across the body of the characterization of the person, animal, creature, monster, alien, or thing.

6. The apparatus of claim 5, wherein the sash includes a plurality of pockets for storage of various objects.

7. The apparatus of claim 6, wherein a warrantee of ownership is enclosed in one of the plurality of pockets disposed in the sash.

8. The apparatus of claim 1, wherein the head portion includes a soft, filled interior portion usable as a pillow.

9. The apparatus of claim 1, wherein the top fabric portion is releasably secured to the bottom fabric portion with strips of hook and loop fasteners extending substantially along left and right sides, and the bottom ends of the top and bottom fabric portions.

10. The apparatus of claim 1, wherein the visual light source comprises a light emitting diode, with electric current supplied by batteries disposed within the head portion.

11. The apparatus of claim 1, wherein the visual light source disposed in the head portion, is aligned with the indicia representative of a face, in proximity to the eyes of the person, animal, creature, monster, alien, or thing.

12. The apparatus of claim 1, wherein the top fabric portion is releasably secured to the bottom fabric portion about the left and right sides and the lower end with zippers.

13. The apparatus of claim 1, wherein the indicia on the top fabric portion forming the characterization of a body of a person, animal, creature, monster, alien, or thing, includes legs extending from approximately the mid-portion of the top fabric portion to the lower end of the top fabric portion.

14. A combination comforter and sleeping bag apparatus, comprising:

(a) a bottom fabric portion sized to substantially cover the top and end portions of a single bed; the bottom fabric portion having an upper end, left and right sides and a lower end;

(b) a top fabric portion sized to cover the top and end portions of a single bed; the top fabric portion having an upper end, left and right sides and a lower end;

(c) indicia in the form of the characterization of a body of a person, animal, creature, monster, alien or thing disposed upon one side of the top fabric portion;

(d) a head portion removably secured to the top side of the bottom fabric portion; the head portion having indicia in the form of the characterization of the face of the person, animal, creature, monster, alien, or thing disposed thereon;

(e) an audio device having speakers disposed within the head portion to transmit audio signals from the audio device;

(f) at least one visual light source disposed within the head portion; and (g) a battery source with a switching device disposed within the head portion to selectively power the audio device and the visual light source.

15. The apparatus of claim 14, wherein the speakers are foam cell speakers.

16. A combination comforter and sleeping bag apparatus, comprising:

(a) a bottom fabric portion sized to substantially cover the top portion of a single bed; the bottom fabric portion having an upper end, left and right sides, and a lower end;

(b) a top fabric portion sized to cover the top portion of a single bed; the top fabric portion having an upper end, left and right sides and a lower end;

(c) indicia in the form of the characterization of a body of a person, animal, creature, monster, alien or thing disposed upon one side of the top fabric portion;

(d) a head portion removably secured to the top side of the bottom fabric portion; the head portion having indicia in the form of the characterization of a face of the person, animal, creature, monster, alien or thing disposed upon the top fabric portion;

(e) a visual light source disposed in the head portion, and actuated by a switch;

(f) an audio device with speakers disposed within the head portion, the audio device actuated by a switch to selectively transmit audio signals in proximity to the user of the apparatus;

(g) a battery source disposed within the head portion to selectively provide electric power to the audio device and to the visual light source; and (h) a sash portion extending disgonally across the body of the characterization of the person, animal, creature, monster, alien or thing, the sash portion having a plurality of pockets disposed in side by side relation, for storage of various objects.

17. The apparatus of claim 16, wherein the top fabric portion is releasably secured to the bottom fabric portion with strips of hook and loop fasteners extending substantially along the left and right sides, and the bottom ends of the top and bottom fabric portions.

18. The apparatus of claim 16, wherein the head portion includes a soft, filled interior portion usable as a pillow.

* * * * *